United States Patent [19]

Chu et al.

[11] Patent Number: 4,583,872

[45] Date of Patent: Apr. 22, 1986

[54] PAPER SUPPLY AND STACKING APPARATUS

[75] Inventors: Mosi Chu, Setauket; David Chiang, Dix Hills; Solomon Manber, Sands Point, all of N.Y.

[73] Assignee: MCC Associates, Bohemia, N.Y.

[21] Appl. No.: 604,748

[22] Filed: Apr. 27, 1984

Related U.S. Application Data

[63] Continuation-in-part of Ser. No. 321,419, Nov. 16, 1981, Pat. No. 4,456,240.

[51] Int. Cl.[4] ..... B41J 13/02

[52] U.S. Cl. ..... 400/625; 400/636.2; 271/242; 271/145

[58] Field of Search ..... 400/624, 625, 630, 636.2; 271/4, 145, 9, 242, 243, 226

[56] References Cited

U.S. PATENT DOCUMENTS

| | | | |
|---|---|---|---|
| 4,248,415 | 2/1981 | Steinhilber | 271/9 |
| 4,268,021 | 5/1981 | Rutishauser et al. | 400/636.2 |
| 4,275,969 | 6/1981 | Matsuhisa et al. | 400/625 |
| 4,300,756 | 11/1981 | Danchak, Jr. et al. | 271/242 |
| 4,362,409 | 12/1982 | Endo et al. | 400/625 |
| 4,456,240 | 6/1984 | Chu et al. | 271/145 |

FOREIGN PATENT DOCUMENTS

| | | | |
|---|---|---|---|
| 2438483 | 2/1975 | Fed. Rep. of Germany | 271/242 |
| 3305341 | 9/1983 | Fed. Rep. of Germany | 400/625 |
| 115532 | 9/1980 | Japan | 271/242 |
| 2026391 | 2/1980 | United Kingdom | 400/625 |

OTHER PUBLICATIONS

Hammond et al, "Copier Exit Tray", IBM Technical Disclosure Bulletin, vol. 20, No. 6, pp. 2122–2124.

*Primary Examiner*—William Pieprz

*Attorney, Agent, or Firm*—Roberts, Spiecens & Cohen

[57] ABSTRACT

A paper tray having a bottom, front and rear walls extending upwardly from the bottom, and side walls extending upwardly from the bottom to define an open boxlike structure for storage of sheets of paper in readiness for use. A paper receiver is pivotably mounted on the tray for receiving sheets of paper after printing thereof. The paper receiver has a first position in which paper can be fed automatically from the tray to a print roller and a second position in which paper can be manually fed to the print roller. In the automatic mode, the paper is fed by a drive roller to produce a buckle at its leading position to insure alignment at the print roller and subsequent straight, unskewed feed. The paper receiver carries a conveyor belt driven from the print roller at a greater linear speed to insure positive feed of the paper from the print roller to a receiving station.

13 Claims, 6 Drawing Figures

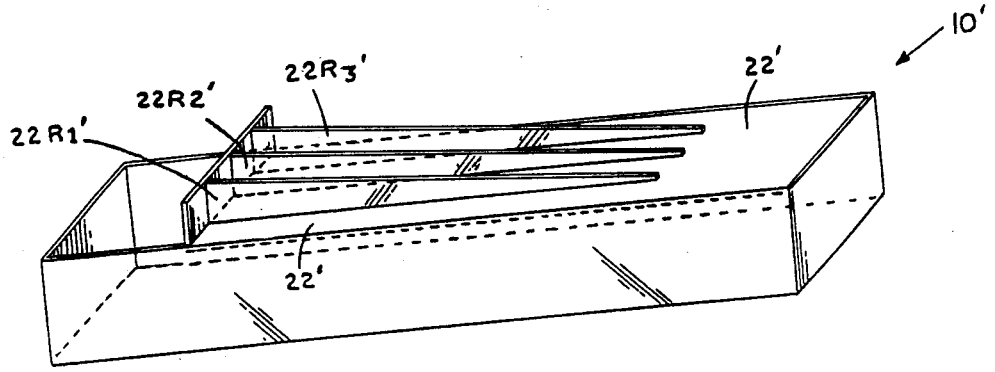
FIG. 5
FIG. 4
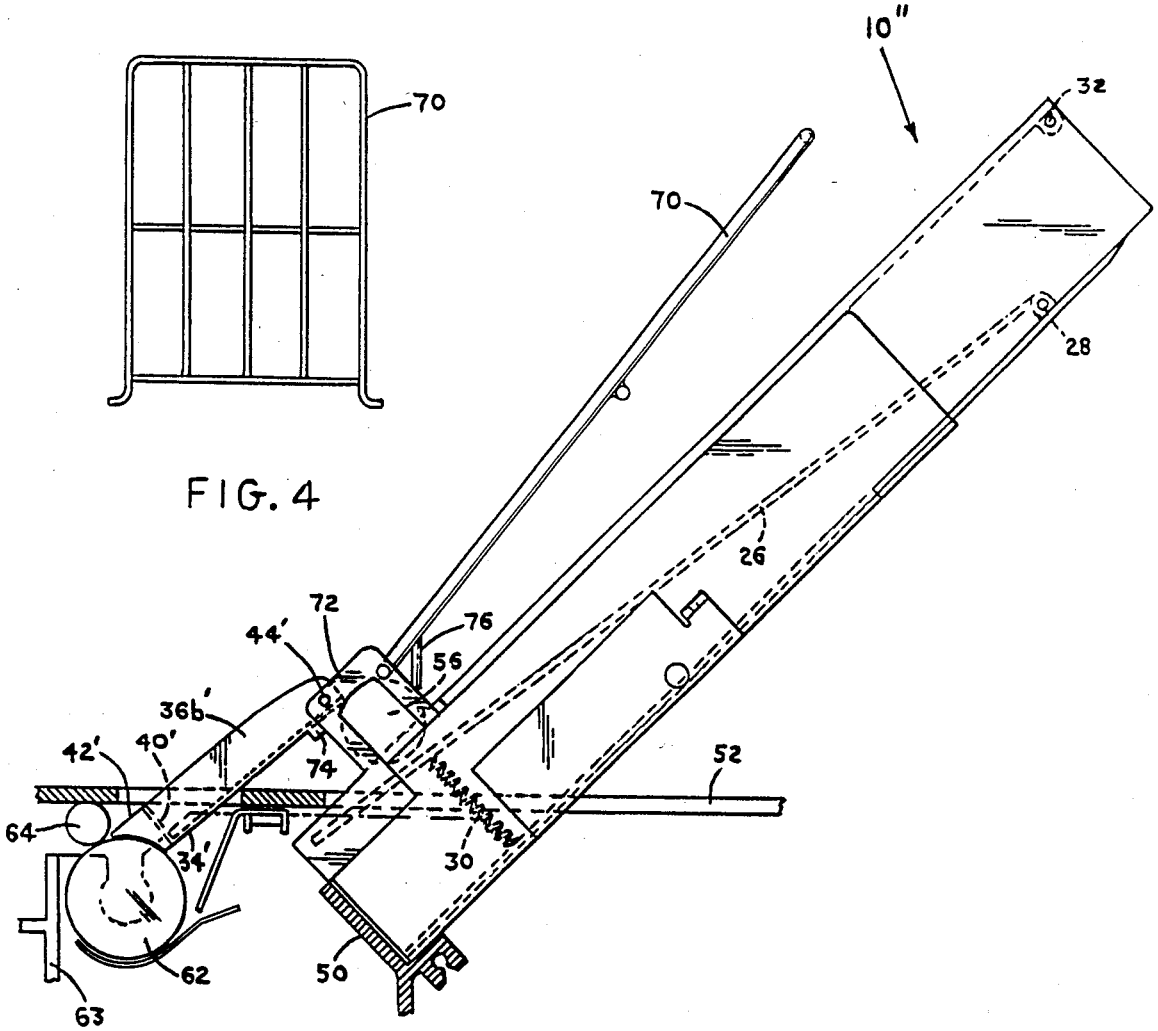
FIG. 3

PAPER SUPPLY AND STACKING APPARATUS

CROSS RELATED APPLICATION

This Application is a continuation-in-part of Application Ser. No. 321,419 filed Nov. 16, 1981 now issued as U.S. Pat. No. 4,456,240, June 26, 1984.

FIELD OF THE INVENTION

This invention relates to the feeding and stacking of paper in a printer.

BACKGROUND

In word processors and similar types of printers it is often desirable to operate the processor in an automatic mode. In particular, one would like to automatically feed a sheet of paper into the processor, initiate the typing and at the end of the typing, feed the completed sheet to a stacking mechanism. At present, such facilities are available provided one couples a sheet feeder to the input of the word processor and couples a paper stacker to the output of the printer of the processor. Thus, when the processor uses a conventional type roller mechanism the paper is fed from the sheet feeder into say the bottom of the roller and as the paper comes off the top of the roller it is delivered to a conveyor or belt arrangement onto a stacker. Such accessories and, particularly, the stacker portion have been found to be relatively complicated, expensive and unreliable.

Furthermore, there are times when the word processor is to be used in a non-automatic mode. In that case, the operator would normally load the sheet of paper into the bottom of the roller and manually remove the paper from the top of the roller. If the word processor is fitted with the above-mentioned feeder and stacker it is necessary to minimally move the stacker out of position to provide access for the operator to feed and remove the paper. The removal of the stacker quite often causes many complications, so that, in the end, in conventional offices the stacker is permanently removed and the automatic operation only takes place for the feeding part of a cycle.

SUMMARY OF THE INVENTION

It is, therefore, a general object of the invention to provide improved apparatus for feeding paper to and stacking paper from a printer.

According to one aspect of the invention, there is contemplated a paper tray having a first bottom as well as first front and rear walls extending upwardly from the bottom. In addition, first and second lower side walls also extend upwardly from the bottom so that the walls and the bottom define an open boxlike structure for the storage of sheets of paper prior to use. A cover is pivotably mounted on the top of the lower side walls adjacent to the rear wall. This cover extends toward the first front wall but is shorter than the first bottom so that a gap exists between the free end of the cover and the first front wall. Accordingly, paper can be removed from the boxlike structure through such gap. Each of the lower side walls has an extension which upwardly extends beyond the level of the cover. Attached to these extensions is a paper receiving means which has a second bottom upwardly displaced from and overhanging the gap and the first front wall. There are first and second upper side walls connected to the extensions of the lower side walls and extending upwardly from the upper bottom. A second front wall also extends upwardly from the edge of the second bottom remote from its connection to the extensions. The second bottom, the upper side walls and the second front walls define a receptacle for receiving, after use, sheets of paper initially stored in, the defined open box structure.

According to a further aspect of the invention, the paper tray carries a pivotable receiver which receives printed paper from the print roller and conveys the same to a receiving station. The receiver is pivotable between a first position in which paper automatically fed from the tray is conveyed by the receiver to a receiving station and a second position in which paper can be manually fed to a print roller and manually retrieved.

A further object of the invention is to provide means for alignment of the paper so that it is conveyed by the print roller to a print station in straight unskewed condition.

In accordance with a feature of the invention, the alignment is achieved by the provision of means which feeds the paper to the print roller with a slight overfeed to produce a buckle in the paper after it has aligned itself against the print roller.

Another object of the invention is to provide means for positive conveyance of the paper after it has undergone a print operation.

According to a further feature of the invention, this is achieved by providing a conveyor means in the receiver which is driven from the print roller at a linear speed greater than that of the print roller.

Further objects, features and other aspects of the invention will become evident from a consideration of specific embodiments to be taken hereafter with reference to the attached drawings.

BRIEF DESCRIPTION OF THE DRAWING

Other objects, the features and advantages of the invention will become apparent from the following detailed description when read in conjunction with the accompanying drawing which shows the presently preferred embodiments of the invention. In the drawing:

FIG. 3 shows an idealized side view of a portion of a printer in which paper feeding and collecting apparatus is shown in accordance with another aspect of the invention;

FIG. 4 shows a top view of a paper support used in the embodiment of FIG. 3;

FIG. 5 is a perspective view of a variation of the apparatus of FIG. 3.

DESCRIPTION OF THE PREFERRED EMBODIMENTS

Figure 1:
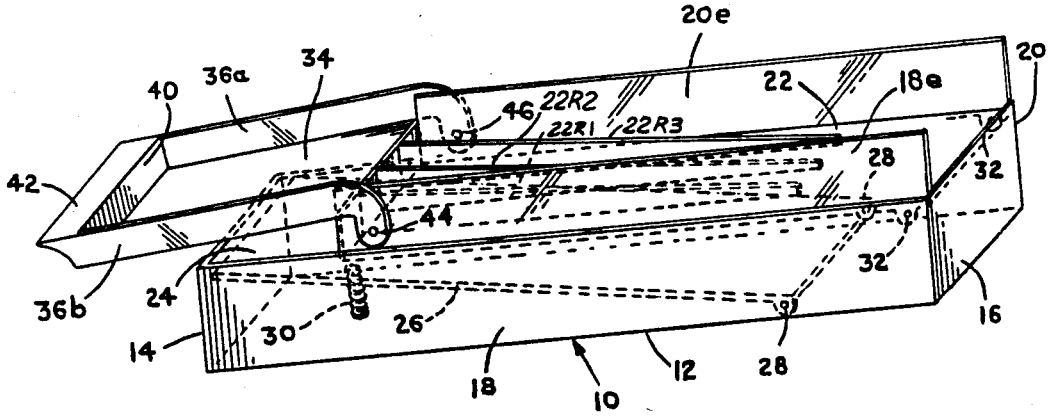
FIG. 1 shows a perspective view of a paper feeding and collecting apparatus in accordance with one aspect of the invention.

In FIG. 1 there is shown a paper tray or carrier 10 having two portions: a sheet feeding portion and a sheet receiving and stacking portion.

The sheet feeding portion includes a bottom 12 from which extend upwardly a front wall 14, a rear wall 16, a first side wall 18 and a second side wall 20. The bottom 12 and the walls 14 to 20 define an open boxlike structure in which is stacked a load of paper. Also within the boxlike structure is a pivotable floor 26 which pivots about pin 28 mounted in the walls 18 and 20. Between the floor 26 and the bottom 12 is a spring-like member 30 which will urge the paper towards the top of the boxlike structure. The boxlike structure is partially covered by a cover 22 which is pivotally mounted near the top of the side walls 18 and 20 in the region of the rear wall 16. The pivotal mounting is provided by a pin 32 mounted in said side walls.

Connected to this boxlike structure is the stacking portion of the tray. In particular, the side walls 18 and 20 include extensions **18*e* and 20*e* which roughly start at the cover and extend upwardly sufficiently high to stack sheets of paper. Pivotably connected to these extensions and close to the gap 24 is a receiving or take-up element 34 having a bottom from which extend upwardly side walls 36*a* and 36*b* and a front wall 40. Extending forward of the front wall 40 is a receiving shelf 42. The entire receiving element is connected to the boxlike structure by means of pins 44 and 46 which provide pivot points between the end of the side walls 36 and 38 respectively and the extensions 18*e* and 20*e* of the side walls 18 and 20. The receiving element can pivot around these pivot points 44 and 46 between the position shown in solid lines and the position shown in dotted lines in FIG. 2. To insure flat stacking of the sheets of paper it is necessary to support the collected sheets substantially parallel to the bottom of the receiving element 34. This is accomplished by providing ramplike ribs 22R1, 22R2 and 22R3**.

Figure 2:
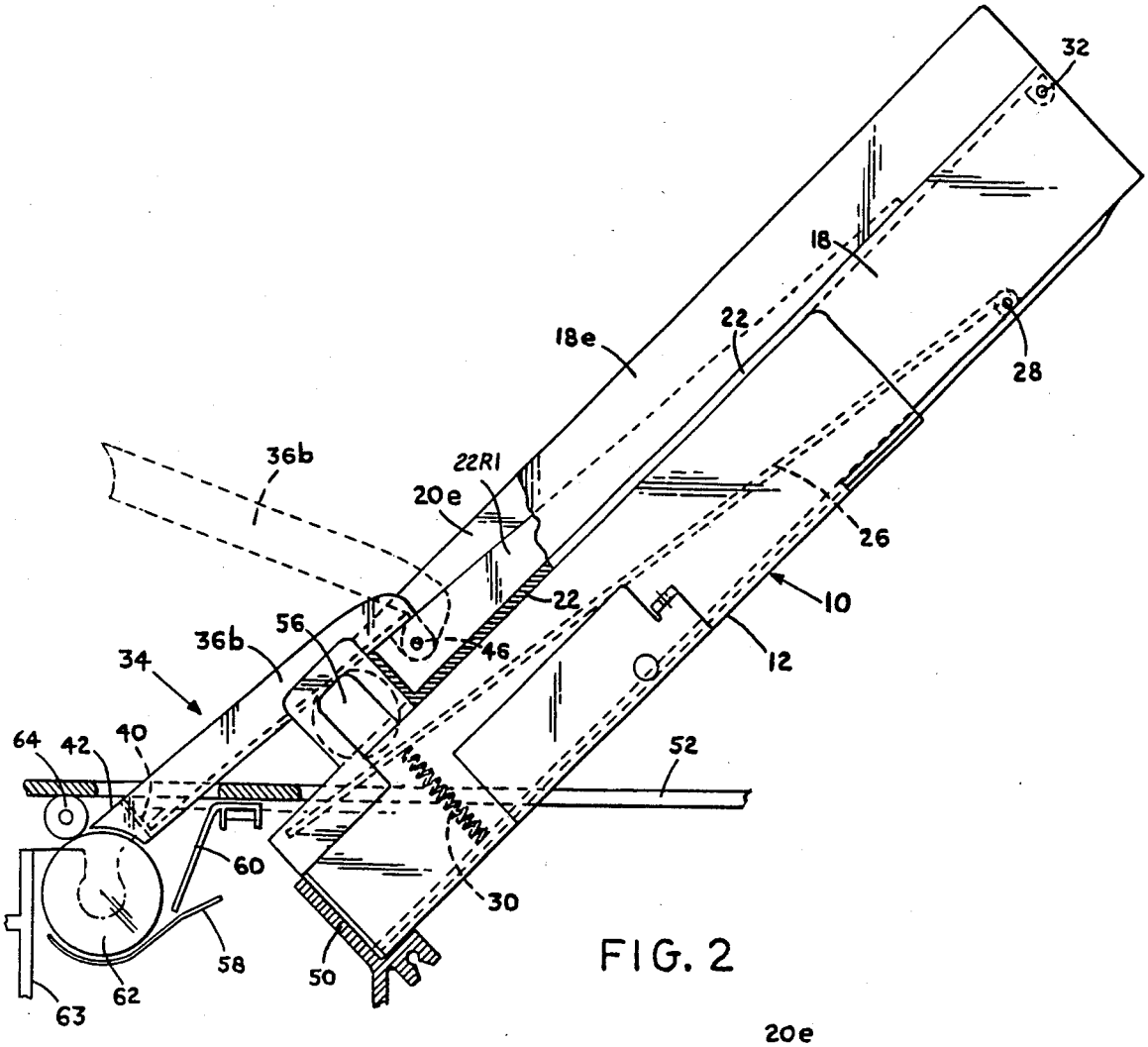
FIG. 2 shows an idealized side view of a portion of a printer in which the apparatus of FIG. 1 is operatively positioned.

In FIG. 2 there is shown the carrier 10 positioned within a printer such as in a word processor. Since the bulk of the printer does not concern the present invention, only those portions of the printer concerned with the invention are shown. In particular, the carrier 10 is supported in the printer by means of the bracket 50. The carrier passes through an opening in the case 52 of the printer. With the carrier in position, the paper within the carrier is urged against the feed roller 56. The feed roller when energized by the printer rotates in a clockwise direction as seen in the Figure and drives the top sheet of paper in the stack onto the paper guide 58. The paper is then urged against the print roller 62. As the paper passes by the print element 63, it is guided between the print roller 62 and an output roller 64. As the print and output rollers rotate, the paper is driven over the receiving shelf 42 into the receiving element. Just before the end of the paper is reached, the print roller 62 and the output roller 64 are given a fast rotational pulse to drive the paper into the portion of the carrier defined by the extensions **18*e*, 20*e* and the cover 22**.

If the printer is to be used for manual operation one rotates the take-up element 24 to the position shown in dotted lines. At the same time the feed portion of the carrier is emptied of paper and/or the drive roller 56 is disabled. Then an operator merely inserts paper between the print roller 62 and the manual paper guide 60. In this way the paper is guided to the paper guide 58 and the operation proceeds as before, except that this time it is necessary for the operator to manually catch or remove the papers as they are fed from the gap between the print roller 62 and the output roller 64.

There has thus been shown an improved paper carrier which can be used both to feed paper to a printer and to stack the paper fed from the printer. In addition, since the carrier is provided with a rotatable stacking portion and since the printer is provided with two paper guides, the printer can simply be converted between manual and automatic feed operation.

The embodiment of FIGS. 1 and 2 contemplates a unitary feeding and stacking apparatus which can be inserted and removed from the printer as a single unit. However, it may be desirable and be economically advantageous to provide a non-unitary structure. Such a variation is shown in FIGS. 3–5 wherein elements similar to those shown in FIGS. 1 and 2 bear the same reference numerals with a prime. The fundamental difference concerns the stacking portion of the apparatus. More particularly, the take-up element 34' is pivotably connected via pin members 44' to side supports 72 of the printer provided with a stop 74. In addition, support of the stacked paper can be provided by upwardly extending ribs as in FIGS. 1 and 2 (see FIG. 5 for a view of the feeding portion with the ribs 22R1' to 22R3'). As a further modification, the support of the stacked paper can be provided by a wire tray 70 which is also pivotably supported by support 72 and may be provided with abutting members 76 which rest against support 72 in operative position for receiving printed sheets of paper. As an alternative, the wire tray can be provided with lateral stops (not shown) which rest on the side walls of the tray in the operative position of the tray 70.

Figure 6:
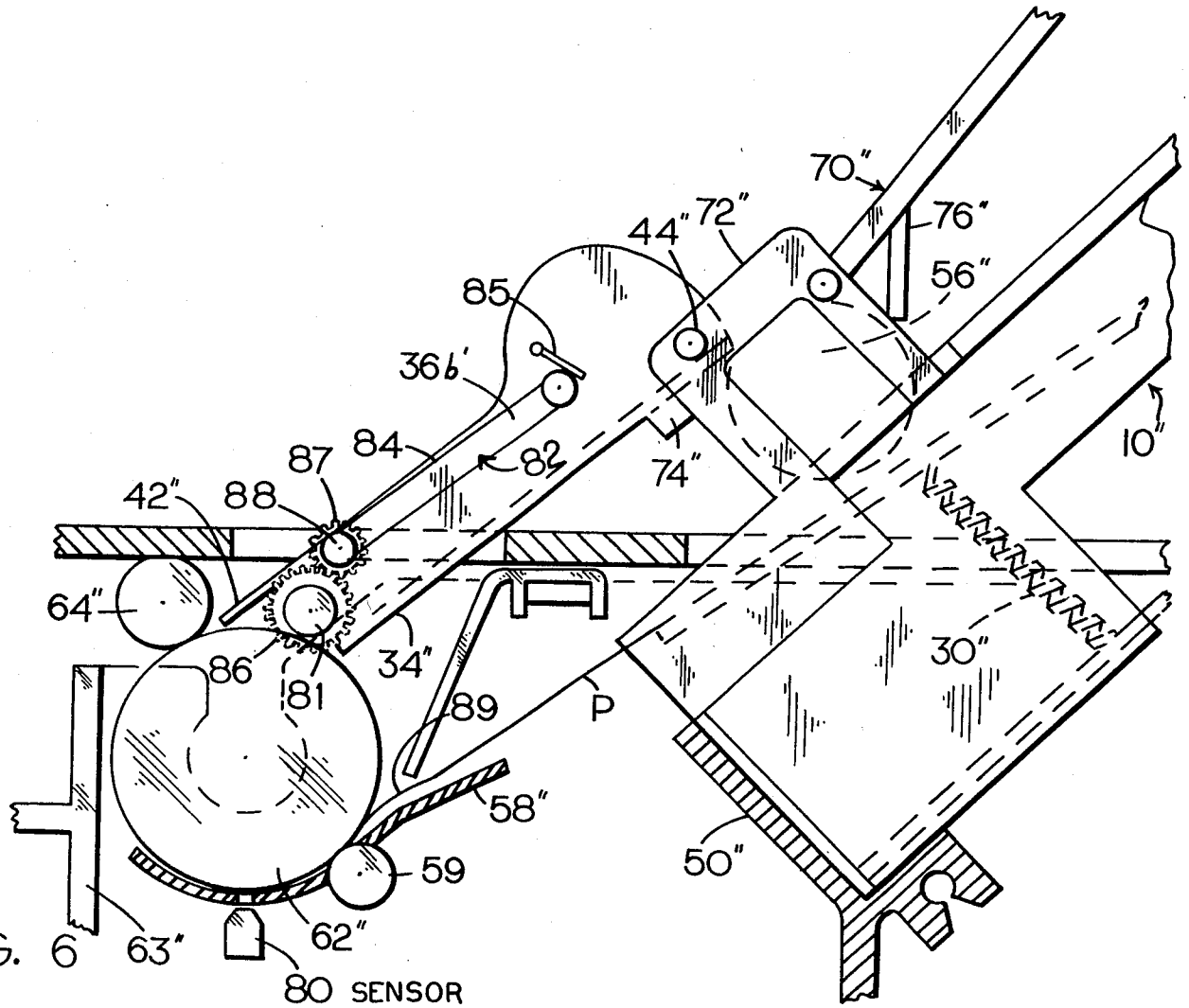
FIG. 6 is an idealized side view, on enlarged scale, of a modified portion of the paper feeding and collecting apparatus of FIG. 3.

FIG. 6 shows a modified embodiment in which improvements have been provided so that paper fed from the tray to the print roller is supplied to the print element in straight unskewed condition and so that printed paper is positively conveyed from the print roller to the receiving element. Elements in FIG. 6 which are similar to those in the embodiment in FIGS. 3 and 4 are given the same numerals with double primes.

In FIG. 6 there is seen drive roller 56'' which serves the purpose of advancing the topmost sheet in the tray 10' towards the print roller 62'' of the printer. The guide 58'' is associated with a guide roller 59 which faces the print roller 62'' and is frictionally driven thereby. A paper sensor 80 faces the print roller 62'' downstream of roller 59 for detecting the presence of paper to control the operation of the roller 56'' and print roller 62'' to be explained later.

The receiving element 34'' carries a roller 81 which frictionally bears against the print roller 62'' when the receiving element is in the operative receiving position as shown in FIG. 6. The roller 81 is frictionally driven by the print roller 62'' and in turn drives an endless conveyor belt 82 supported by the receiving element through the intemediary of a step-up gearing composed of gears 86 and 87. The shelf 42'' which projects towards the rollers 62'' and 64'' serves as a guide to receive the printed paper therefrom to guide the paper to the upper run 84 of the belt 82. A hinged plate 85 is loosely mounted for free pivotable movement on the receiving element at the discharge end of the upper run 84 of the belt 82 to apply light pressure, by gravity, to the discharged paper for proper feed thereof into the reception zone of the receiving element and thence onto the wire tray 70''.

In operation, when a signal is received indicating the need for feed of paper for a printing operation, the roller 56'' is energized to feed the topmost sheet of paper in the tray 10'' to the guide 58'' and the rollers 62'' and 59. The rollers 62'' and 59 remain at rest and the magnitude of angular rotation of drive roller 56'' is regulated so that the leading edge of the paper aligns itself at the nip between the rollers 62'' and 59 producing a slight buckle 89 in the paper P as shown in FIG. 6.

The leading edge of the paper is now transversely aligned at the nip and the roller 62″ is energized to advance the paper further in perfectly straight longitudinal alignment even if the paper had been initially fed by the rollers 56′ in skewed condition. Hence, the slight overfeed of the paper by the roller 56″ to the stationary rollers 59 and 62″ serves as a means to align the leading edge of the paper at the nip between the rollers 59 and 62″ by producing a buckle in the paper. After the buckle in the paper is produced, the drive roller 56″ is halted and the roller 62″ is energized and the paper sheet, whose alignment is now insured, is fed past the sensor 80. The sensor establishes a magnitude of rotation for roller 62″ so that the paper is advanced by a fixed distance, to the nip between the output roller 64″ and print roller 62″. The paper is now in readiness for a printing operation by the printing element 63″.

As the printing operation is carried out on the paper, it is fed by the rollers 62″ and 64″ to the receiving element where it travels over guide 42″ onto the belt 82. The belt 82 is driven with the roller 62″ through the intermediary of the friction roller 81. The roller 81 is drivingly coupled to gear 86 which is in mesh with gear 87 which is drivingly secured to the drive roller 88 of the belt 84 through a one way clutch (not shown). Gear 86 has a larger diameter than gear 87 to form the step-up gearing such that the belt 82 is driven at a greater linear speed than the roller 62″. Thereby, the printed sheet of paper will be pulled with slight tension from the roller 62″ by the belt 82 and the paper will be positively fed under the hinged plate 85 at the discharge end of the belt 82 into the receiving section and thereafter onto the tray 70″.

When the trailing edge of the paper sheet passes sensor 80, print roller 62″ will continue to rotate through a fixed angular travel until the paper sheet has cleared the nip between the print roller 62″ and output roller 64″ and the paper sheet is fed by the conveyor belt to the wire tray 70″. During this travel, the roller 56″ is activated to feed a new sheet of paper to the rollers 62″ and 59 and the operation is repeated.

Although several embodiments of the invention have been shown and described in detail, there will now be obvious to those skilled in the art many modifications and variations satisfying many or all of the objects of the invention without departing from the scope and spirit of the invention as defined in the attached claims.

What is claimed is:

1. A paper feed, storage and collector apparatus for a printer having a print roller, a print element opposite the print roller, a paper guide for guiding a sheet of paper between the print element and print roller, and an output roller opposite the print roller and located past the print element, said paper feed, storage and collector apparatus comprising storage means for storing a stack of paper, means for advancing a sheet of paper from said stack to the print roller via the paper guide, means for aligning the sheet of paper at the print roller by continuing the feed of the paper to produce a slight buckle in the paper, the now aligned sheet of paper thereafter being advanced by the print roller to a print station at which the print head performs a printing operation and thereafter the printed paper is advanced by the print roller and output rollers, and receiver means for the printed paper comprising a pivotal take-up member movable between first and second positions and in said first position a sheet of paper can be fed from the storage means to the print roller via the paper guide and, after printing, from the print roller to the take-up member, said take-up member including a conveyor belt having an inlet end positioned adjacent the print roller with the take-up member in said first position for receiving the printed paper from the print roller, and drive means of for driving said conveyor belt with the take-up member in the first position to convey the printed paper to a receiving station of the receiver means, the position of said inlet end of said conveyor belt with the take-up member in said first position being such that the printed paper is conveyed by said conveyor belt while the printed paper is still engaged by the roller and output roller said take-up member in said second position disengages said drive means and rendering said conveyor belt inoperative and permitting manual insertion of sheets of paper to the print roller and manual retrieval of printed sheets.

2. A paper feed, storage and collector apparatus as claimed in claim 1 wherein said driving means drives said conveyor belt from the print roller at a linear speed which is greater than the linear speed of the print roller.

3. A paper feed, storage and collector apparatus as claimed in claim 2 wherein said drive means for driving said conveyor belt comprises a friction roller carried by said take-up member and resting in frictional drive relation with the print roller when the take-up member is in said first position.

4. A paper feed, storage and collector apparatus as claimed in claim 3 wherein the drive means for driving the conveyor belt from the print roller further comprises a step-up gearing between said friction roller and said conveyor belt.

5. A paper feed, storage and collector apparatus as claimed in claim 1 comprising paper sensor means, located downstream of the means which advances a sheet of paper for controlling the energization of such means and the print roller.

6. A paper feed, storage and collector apparatus as claimed in claim 1 wherein said conveyor belt has a discharge end and said apparatus further comprises a hinged plate which applies pressure, by gravity, to the sheet of paper being fed past said discharge end to said receiving station.

7. In a printer having a print roller, a print element opposite the print roller, a paper guide for guiding a sheet of paper between the print element and print roller, an output roller opposite the print roller and located past the print element, and an input roller opposite the print roller before the print element, the improvement comprising paper feed, storage and paper collector means for feeding sheets of paper to a gap between the paper guide and the print roller and to a nip between the print roller and input roller, and for stacking paper delivered by rotation of the print and output rollers, paper guide means positioned opposite a portion of the print roller for guiding sheets of paper to said gap between the paper guide and print roller and said nip between the print and input rollers, whereby sheets of paper can be fed past the print element from two sources, said paper feed storage and paper collector means comprising a tray for sheets of paper, a paper receiver means including a take-up member pivotably supported with respect to said tray for movement between a first position in which sheets of paper can be fed from said tray as a first of said sources to the print roller and print element via said paper guide and a second position in which sheets of paper can be fed from the second of said sources to the print roller and print element via said paper guide means, said take-up member including conveyor means driven by the print roller for advancing the printed sheet of paper from the print roller, said conveyor means comprising a conveyor belt having an inlet end adjacent said print roller with said take-up means in said first position for receiving printed sheets from said print roller, and drive means for driving said conveyor belt with the take-up member in the first position to convey the sheets to a receiver station, the position of said inlet end of said conveyor belt with the take-up member in said position being such that the printed sheets are conveyed by said conveyor belt while the printed sheets are still engaged by the print roller and output roller, said take-up member in aid second position disengages said drive means rendering said conveyor belt inoperative and permitting manual insertion of sheets of paper to the print roller and manual retrieval of printed sheets.

8. In a printer as claimed in claim 7, said conveyor means including a friction roller carried by said take-up member and resting in frictional drive relation with said print roller when the take-up member is in said first position for driving said conveyor belt.

9. In a printer as claimed in claim 8 wherein said drive means further comprises means for driving the conveyor belt from the friction roller at a linear speed which is greater than that of the print roller.

10. In a printer as claimed in claim 9 wherein the means for driving the conveyor means from the friction roller comprises a step-up gearing.

11. In a printer as claimed in claim 7 wherein said conveyor belt has a discharged end and comprising a hinged plate at said discharge end for applying pressure by gravity action on each sheet of paper being fed past said discharge end by said conveyor belt.

12. In a printer as claimed in claim 7, said paper feed, storage and paper collector means further including drive roller means for advancing the paper to said gap and nip and to feed the paper against the nip to cause the edge of the paper to align itself transversely at said nip while producing a buckle in the paper.

13. In a printer as claimed in claim 12 comprising paper sensor means downstream of said nip for controlling enerization of said drive roller means and said print roller.

* * * * *